US006251031B1

(12) United States Patent
Hayashi et al.

(10) Patent No.: US 6,251,031 B1
(45) Date of Patent: Jun. 26, 2001

(54) MULTI-PIECE SOLID GOLF BALL

(75) Inventors: Junji Hayashi; Hisashi Yamagishi; Hiroshi Higuchi; Yasumasa Shimizu, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/377,992

(22) Filed: Aug. 20, 1999

(30) Foreign Application Priority Data

Aug. 20, 1998 (JP) ..... 10-234451
Aug. 20, 1998 (JP) ..... 10-234456

(51) Int. Cl.[7] ..... A63B 37/06
(52) U.S. Cl. ..... 473/376
(58) Field of Search ..... 473/373, 374, 473/367, 368, 370, 371, 377, 376

(56) References Cited

U.S. PATENT DOCUMENTS 5,733,205 * 3/1998 Higuchi et al. ..... 473/373
5,743,816 4/1998 Ohsumi et al. .
5,772,531 6/1998 Ohsumi et al. .

FOREIGN PATENT DOCUMENTS 2 302 035 1/1997 (GB) ..... A63B/37/00
2 302 036 1/1997 (GB) ..... A63B/37/00
2 302 037 1/1997 (GB) ..... A63B/37/00
9-266959 10/1997 (JP) .
10-127818 5/1998 (JP) .
10-127819 5/1998 (JP) .

* cited by examiner

*Primary Examiner*—Jeanette Chapman
*Assistant Examiner*—Raeann Gorden
(74) *Attorney, Agent, or Firm*—Sughrue, Mion, Zinn, Macpeak & Seas, PLLC

(57) ABSTRACT

In a multi-piece solid golf ball comprising a solid core, an enclosure layer, an intermediate layer, and a cover, the core has a deflection of 2.5–7.0 mm under a load of 100 kg, the cover has a Shore D hardness of 53–65, and the Shore D hardness of the cover is higher than that of the intermediate layer. The intermediate layer and the cover are formed mainly of thermoplastic resins of the same type and either one contains an inorganic filler. The ball has improved resilience, durability and a soft pleasant feel.

16 Claims, 1 Drawing Sheet

MULTI-PIECE SOLID GOLF BALL

This invention relates to a multi-piece solid golf ball comprising at least four layers, a solid core, an enclosure layer, an intermediate layer, and a cover and having high resilience, durability and a very soft pleasant feel.

BACKGROUND OF THE INVENTION

Many solid golf balls such as two-piece golf balls are known in the art. As compared with the wound golf balls, solid golf balls have the advantage of an increased total flight distance on both driver and iron shots, because of a so-called straight line trajectory and a low spin rate due to their structure, which allows for a long run. On the other hand, the solid golf balls are more difficult to control than the wound golf balls in that they do not stop short on the green because of low spin receptivity on iron shots.

Like flight distance, a pleasant feel when hit is essential for golf balls. The absence of a pleasant feel represents a substantial loss of commodity value of the golfball. As compared with the solid golf balls, wound golf balls have the structural characteristics ensuring a soft and pleasant feel.

On two-piece solid golf balls consisting of a core and a cover, attempts have been made to soften the ball structure in order to accomplish a soft feel upon impact. However, such attempts fail to fully meet the demand. By providing an intermediate layer between the core and the cover, three-piece solid golf balls were obtained. Although many proposals were made, it was still difficult to provide a golf ball having both the flight distance of two-piece solid golf balls and the feel of wound golf balls.

Recently, multi-piece solid golf balls having at least four layers were proposed (see JP-A 9-266959, 10-127818, and 10-127819). One solid golf ball proposed is of the four-layer structure in which a three-layer structure solid core consisting of an internal layer, an intermediate layer and an outer layer is enclosed with a cover. The ball is improved in hitting feel and control by providing a difference in hardness between the respective layers.

However, if the difference in hardness between two adjacent layers is reduced, little improvement in hitting feel is achieved. If the difference in hardness between two adjacent layers is significant or if the selection of the thickness or material of the adjacent layers is inappropriate, the deflection or deformation upon impact becomes largely different between the adjacent layers. This causes an energy loss at the interface therebetween and thus detracts from resilience, resulting in a reduced flight distance. The durability of the ball against consecutive strikes is also lost. This tendency becomes outstanding particularly when two adjacent layers are formed of different materials which cannot be strongly joined.

SUMMARY OF THE INVENTION

An object of the invention is to provide a multi-piece solid golf ball comprising a solid core, an enclosure layer, an intermediate layer, and a cover which has a very soft feel and high durability against consecutive strikes while maintaining the flight performance of solid golf balls.

The invention is directed to a multi-piece solid golf ball of at least four-layer structure comprising a solid core, an enclosure layer of at least one layer surrounding the core, an intermediate layer surrounding the enclosure layer, and a cover of at least one layer surrounding the intermediate layer. The inventor has found that by properly selecting the hardness, thickness and material of the respective layers, the multi-piece solid golf ball can be improved in resilience and durability and provided with a very soft, pleasant feel. More particularly, the inventor has found the following. (1) The intermediate layer and the cover are formed mainly of thermoplastic resins of the same type, especially ionomer resins. This strengthens the bond between these layers, contributing to durability. (2) The intermediate layer is made softer than the cover, and the enclosure layer is made softer than the intermediate layer. That is, the ball is constructed such that the layers are made softer as they are positioned more inside. This order of hardness minimizes the energy loss by deformation upon impact, prevents any loss of resilience, improves the durability of the ball, and imparts a soft feel. (3) The enclosure layer surrounding the core is formed mainly of a thermoplastic resin characterized by softness and resilience, especially a thermoplastic polyester elastomer or polyurethane elastomer. (4) An inorganic filler is added to at least one of the intermediate layer and the cover. Owing to the reinforcing effect of the filler, the ball is improved in durability.

In a first aspect, the invention provides a multi-piece solid golf ball comprising a solid core, an enclosure layer of at least one layer around the core, an intermediate layer around the enclosure layer, and a cover of at least one layer around the intermediate layer. According to the invention, the solid core has a hardness corresponding to a deflection of 2.5 to 7.0 mm under an applied load of 100 kg, the cover has a Shore D hardness of at least 53, and the Shore D hardness of the cover is higher than the Shore D hardness of the intermediate layer. The intermediate layer and the cover are formed mainly of thermoplastic resins of the same type. In addition to the above requirements, a second aspect requires that at least one of the intermediate layer and the cover contains an inorganic filler. Preferably the enclosure layer has a Shore D hardness of 10 to 50, and the Shore D hardness of the enclosure layer is lower than the Shore D hardness of the intermediate layer. Since the hardness, thickness and material of the respective layers are properly selected so that the respective layers may cooperate synergistically to construct a minimized energy loss ball structure, the multi-piece solid golf ball of the invention exhibits favorable flight performance by virtue of improved resilience and gives a very soft, pleasant feel. Moreover, owing to the reinforcing effect of the filler which is added to either one of the intermediate layer and the cover, the ball is outstandingly improved in durability against consecutive strikes.

DESCRIPTION OF THE PREFERRED EMBODIMENTS

Figure 1:
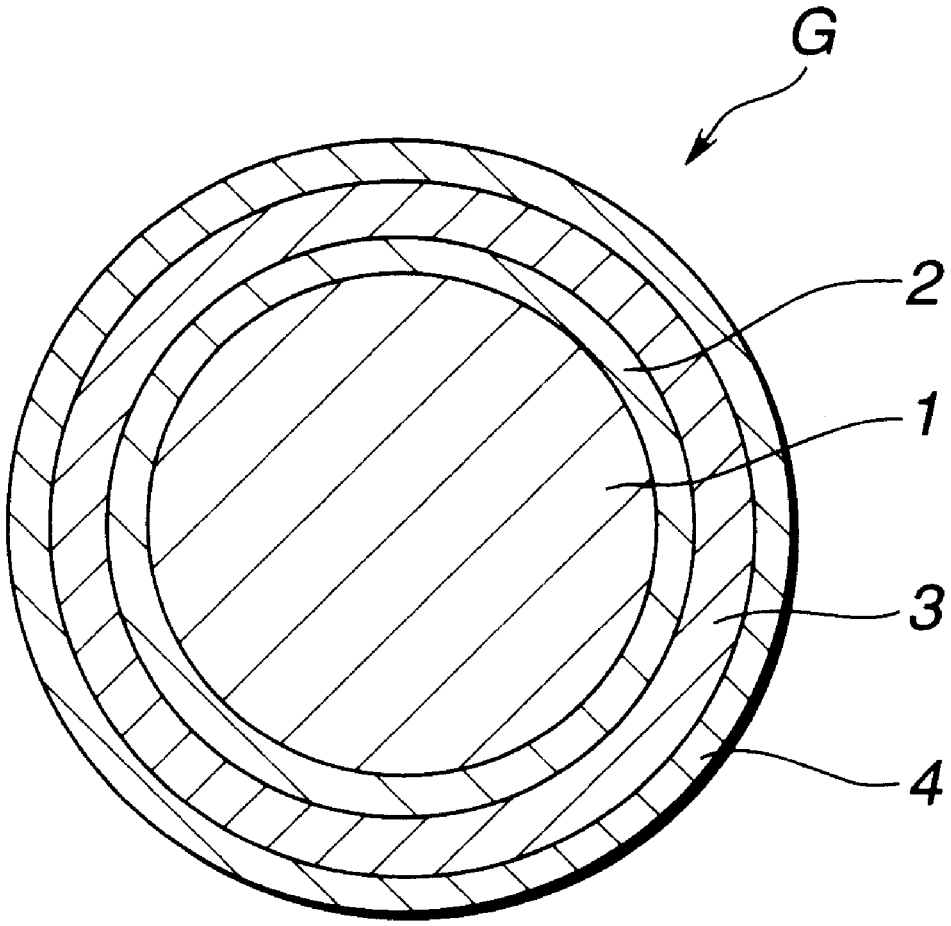
FIG. 1 is a cross-sectional view of a multi-piece solid golf ball according to one embodiment of the invention.

Referring to FIG. 1, a multi-piece solid golf ball G according to the invention is schematically illustrated as comprising a solid core 1, an enclosure layer 2 of at least one layer surrounding the core 1, an intermediate layer 3 surrounding the enclosure layer 2, and a cover 4 of at least one layer surrounding the intermediate layer 3.

The solid core may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc diacrylate, and esters such as trimethylpropane methacrylate. Of these, zinc diacrylate is preferred because it can impart high resilience. The crosslinking agent is preferably used in an amount of about 10 to 40 parts by weight per 100 parts by weight of the base rubber. A vulcanizing agent such as dicumyl peroxide may also be blended in the rubber composition, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 0 to 50 |
| Zinc diacrylate | 10 to 40 |
| Barium sulfate | 0 to 50 |
| Peroxide | 0.1 to 5.0 |
| Antioxidant | appropriate |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

Preferably the solid core has a diameter of 22.7 to 37.7 mm, more preferably 28 to 37 mm.

The core should have a deflection under an applied load of 100 kg of 2.5 to 7.0 mm, preferably 2.8 to 6.8 mm, and more preferably 3.0 to 6.5 mm. With a core deflection of less than 2.5 mm, the feel of the ball would become hard. With a core deflection of more than 7.0 mm, the resilience becomes too low to provide flight performance.

The core is usually formed to a single layer structure from one material although it may also be formed to a multilayer structure of two or more layers of different materials.

According to the invention, the enclosure layer 2 of at least one layer, preferably one or two layers is formed around the core 1. The enclosure layer is composed mainly of a thermoplastic resin, examples of which include ionomer resins, polyester elastomers, polyamide elastomers, styrene elastomers, polyurethane elastomers, olefin elastomers and mixtures thereof. Of these, the thermoplastic polyester elastomers and polyurethane elastomers are preferred since they provide good resilience at the desired hardness. Use may be made of commercially available elastomers such as "Hytrel" from Toray-Dupont K.K. and "Pandex" from Dai-Nippon Ink & Chemicals K.K.

To the enclosure layer composition, there may be added antioxidants and dispersants such as metal soaps, if necessary.

Any desired method may be used in forming the enclosure layer around the core. Conventional injection or compression molding may be employed.

The enclosure layer preferably has a thickness of 1.0 to 5.0 mm, more preferably 1.0 to 4.0 mm and a Shore D hardness of 10 to 50, more preferably 15 to 47.

The intermediate layer 3 is formed around the enclosure layer 2. The intermediate layer may be formed mainly of a conventional thermoplastic resin, examples of which include polyester elastomers, ionomer resins, styrene elastomers, polyurethane elastomers, hydrogenated butadiene resins and mixtures thereof. Of these, the ionomer resins are preferred. Use may be made of commercially available ionomer resins such as "Himilan" from Mitsui-Dupont Polychemical K.K. and "Surlyn" from Dupont. To the intermediate layer composition, there may be added UV absorbers, antioxidants and dispersants such as metal soaps, if necessary.

Any desired method may be used in forming the intermediate layer around the enclosure layer. Conventional injection or compression molding may be employed.

The intermediate layer preferably has a thickness of 0.5 to 3.5 mm, more preferably 0.7 to 3.0 mm and a Shore D hardness of 45 to 63, more preferably 50 to 60. The Shore D hardness of the intermediate layer should preferably be higher than that of the enclosure layer. The hardness difference therebetween is preferably 5 to 50 Shore D units.

The cover 4 is formed mainly of a material of the same type as the material of the intermediate layer 3, especially an ionomer resin. When the intermediate layer and the cover are made of materials of the same type, they can be firmly joined, leading to an improvement in durability. To the cover composition, there may be added UV absorbers, antioxidants and dispersants such as metal soaps, if necessary.

The cover is formed of at least one layer, preferably one or two layers. Any desired method may be used in forming the cover around the intermediate layer. Conventional injection or compression molding may be employed.

The cover preferably has a thickness of 0.5 to 3.5 mm, more preferably 0.7 to 3.0 mm. The thickness of the intermediate layer and the cover combined is preferably 1.5 to 5.0 mm, more preferably 2.0 to 4.5 mm.

The cover has a Shore D hardness of at least 53, preferably 53 to 65. The Shore D hardness of the cover should be higher than the Shore D hardness of the intermediate layer. The hardness difference therebetween is preferably up to 20 Shore D units, more preferably 1 to 15 Shore D units. If the Shore D hardness of the cover is lower than that of the intermediate layer, the ball structure capable of minimizing the energy loss by deformation upon impact is not obtained, failing to attain the objects of the invention.

According to the invention, an appropriate amount of an inorganic filler is preferably added to at least one of the cover and the intermediate layer, that is, only the cover, only the intermediate layer, or both the cover and the intermediate layer. The preferred composition for either the cover or the intermediate layer contains 100 parts by weight of the resin component and 5 to 50 parts, more preferably 10 to 45 parts by weight of the inorganic filler. Less than 5 parts of the filler would provide little reinforcement whereas more than 50 parts of the filler would adversely affect dispersion and resilience.

The inorganic filler blended herein generally has a mean particle size of 0.01 to 100 $\mu$m, preferably 0.1 to 10 $\mu$m, and more preferably 0.1 to 1.0 $\mu$m. Outside the range, larger or smaller filler particles would be difficult to disperse, failing to achieve the objects of the invention. The inorganic filler preferably has a specific gravity of up to 4.8. When loaded with an inorganic filler having a specific gravity of more than 4.8, the cover or intermediate layer itself becomes heavy, which is sometimes impractical for golf balls whose overall weight is prescribed by the Rules of Golf. Examples of the inorganic filler include barium sulfate, titanium dioxide, and calcium carbonate. They may be used alone or in admixture of two or more. Barium sulfate is most preferable.

The intermediate layer or cover loaded with the inorganic filler should preferably have a specific gravity of 1.0 to 1.5, more preferably 1.05 to 1.45.

In the multi-piece solid golf ball of the invention, the hardness, thickness and material of the respective layers are properly selected. More particularly, (1) the intermediate layer and the cover are formed mainly of thermoplastic resins of the same type, especially ionomer resins. (2) The ball is structured such that the intermediate layer is made softer than the cover, and the enclosure layer is made softer than the intermediate layer. That is, the layers are made softer as they are positioned more inside. (3) The enclosure layer surrounding the core is formed mainly of a thermoplastic resin characterized by softness and resilience, especially a thermoplastic polyester elastomer or polyurethane elastomer. (4) Preferably, an inorganic filler is added to at least one of the intermediate layer and the cover. These choices cooperate synergistically to construct a minimized energy loss ball structure. The multi-piece solid golf ball of the invention exhibits favorable flight performance by virtue of improved resilience, gives a very soft feel both upon hitting to a large extent of deformation (with a driver) and upon hitting to a small extent of deformation (with a putter), and has improved durability against consecutive strikes.

The golf ball of the invention is provided on its surface with a multiplicity of dimples. Typically the ball surface is subject to various finish treatments including stamping and paint coating. The ball as a whole preferably has a deflection of 2.0 to 5.5 mm, more preferably 2.3 to 5.0 mm under an applied load of 100 kg. The golf ball must have a diameter of not less than 42.67 mm and a weight of not greater than 45.93 grams in accordance with the Rules of Golf.

EXAMPLE

Examples of the invention are given below by way of illustration and not by way of limitation.

Examples 1–4 & Comparative Examples 1–3

Core-forming rubber compositions of the formulation shown in Table 1 were mixed in a kneader and molded and vulcanized in a core mold at a temperature of 155° C. for about 15 minutes, forming solid cores.

Around the cores, the enclosure layer, intermediate layer and cover were formed by injection molding the corresponding materials of the formulation shown in Table 1, respectively, obtaining solid golf balls of four-layer structure in Examples 1–4 and Comparative Example 3. It is noted that Comparative Example 1 is a two-piece golf ball consisting of the core and the cover (lacking the enclosure and intermediate layers) and Comparative Example 2 is a three-piece golf ball lacking the enclosure layer.

The golf balls were examined for core hardness, ball hardness, flight performance, durability and feel by the following tests. The results are shown in Table 2.

Core and Ball Hardness

The hardness of the core or ball was represented by a deflection (mm) of the core or ball under an applied load of 100 kg.

Flight Performance

A swing robot (by Miyamae K.K.) was equipped with a driver (PRO 230 Titan, loft angle 10°, by Bridgestone Sports Co., Ltd.). The ball was struck with the driver at a head speed of 45 m/sec (HS 45), and the carry and total distance were measured.

Durability

Using a swing robot (by Miyamae K.K.), the ball was repeatedly struck 300 times with a driver (PRO 230 Titan, loft angle 10°, Bridgestone Sports Co., Ltd.) at a head speed of 45 m/sec. For each ball, 10 ball samples were tested and the number of cracked samples was reported.

Feel

Five professional golfers actually hit the ball with a driver and putter and evaluated according to the following criterion.

◎: very soft

○: soft

Δ: ordinary x: hard

TABLE 1

| | composition (parts by weight) | | | | | | |
|---|---|---|---|---|---|---|---|
| | E1 | E2 | E3 | E4 | CE1 | CE2 | CE3 |
| Layer structure | 4L | 4L | 4L | 4L | 2L | 3L | 4L |
| Solid core | | | | | | | |
| Cis-1,4-polybutadiene | 100 | 100 | 100 | 100 | 100 | 100 | 100 |
| Zinc diacrylate | 18.5 | 26.6 | 22.6 | 27.0 | 27.0 | 25.0 | 10.4 |
| Dicumyl peroxide | 0.9 | 0.9 | 0.9 | 0.9 | 0.9 | 0.9 | 0.9 |
| Antioxidant | 0.2 | 0.2 | 0.2 | 0.2 | 0.2 | 0.2 | 0.2 |
| Zinc oxide | 5.0 | 5.0 | 5.0 | 5.0 | 5.0 | 33.5 | 5.0 |
| Barium sulfate | 34.0 | 38.4 | 25.2 | 28.5 | 17.7 | 0.0 | 62.3 |
| Enclosure layer | | | | | | | |
| Hytrel 3078 | 100 | 100 | | | | | |
| Pandex EX7890 | | | 100 | | | | |
| Hytrel 4001 | | | | 100 | | | |
| Pebax 3533 | | | | | | | 100 |
| Intermediate layer | | | | | | | |
| Himilan 1601 | 50 | | | | | | |
| Himilan 1557 | 50 | | | | | | |
| Himilan 1706 | | 60 | 60 | 45 | | 60 | |
| Surlyn 8120 | | 40 | 40 | 55 | | 40 | |
| Cis-1,4-polybutadiene | | | | | | | 100 |
| Zinc diacrylate | | | | | | | 30.8 |
| Dicumyl peroxide | | | | | | | 0.9 |
| Antioxidant | | | | | | | 0.2 |
| Zinc oxide | | | | | | | 5.0 |
| Barium sulfate | | | | | | | 3.37 |
| Cover | | | | | | | |
| Himilan 1601 | | 50 | 50 | | | 50 | |
| Himilan 1557 | | 50 | 50 | | | 50 | |
| Himilan 1605 | 50 | | | | 50 | | 50 |
| Himilan 1706 | 50 | | | 55 | 50 | | 50 |
| Surlyn 8120 | | | | 45 | | | |
| Titanium dioxide | 5.6 | 5.6 | 5.6 | | 5.6 | 5.6 | 5.6 |

Hytrel: the trade name of thermoplastic polyester elastomer by Toray-Dupont K.K.
Pandex: the trade name of polyurethane elastomer by Dai-Nippon Ink & Chemicals K.K.
Pebax: the trade name of polyamide elastomer by Atochem
Himilan: the trade name of ionomer resin by Mitsui-Dupont Polychemical K.K.
Surlyn: the trade name of ionomer resin by Dupont

TABLE 2

| | | E1 | E2 | E3 | E4 | CE1 | CE2 | CE3 |
|---|---|---|---|---|---|---|---|---|
| Core | Outer diameter (mm) | 33.7 | 30.7 | 32.7 | 33.7 | 38.5 | 35.1 | 24.2 |
| | Hardness (mm) | 5.4 | 3.4 | 4.5 | 3.4 | 3.2 | 3.8 | 7.0 |
| Enclosure layer | Thickness (mm) | 1.5 | 3.0 | 2.0 | 1.5 | | | 1.5 |
| | Shore D hardness | 30 | 30 | 40 | 40 | | | 35 |
| Intermediate layer | Thickness (mm) | 1.5 | 1.5 | 1.5 | 1.5 | | 1.8 | 5.5 |
| | Shore D hardness | 59 | 56 | 56 | 53 | | 56 | 55 |
| Cover | Thickness (mm) | 1.5 | 1.5 | 1.5 | 1.5 | 2.1 | 2.0 | 2.3 |
| | Shore D hardness | 63 | 59 | 59 | 55 | 63 | 59 | 63 |
| Ball | Hardness (mm) | 3.9 | 3.2 | 3.4 | 3.2 | 2.6 | 2.8 | 2.8 |
| | Diameter (mm) | 42.7 | 42.7 | 42.7 | 42.7 | 42.7 | 42.7 | 42.7 |
| | Weight (g) | 45.3 | 45.3 | 45.3 | 45.3 | 45.3 | 45.3 | 45.3 |
| Flight performance @ HS45 | Carry (m) | 209.5 | 210.4 | 210.0 | 210.2 | 208.5 | 207.1 | 203.0 |
| | Total (m) | 223.5 | 223.1 | 222.7 | 222.5 | 221.7 | 220.8 | 216.1 |
| Durability | | 1/10 | 0/10 | 0/10 | 0/10 | 1/10 | 1/10 | 10/10 |
| Feel | Driver | ◎ | ○ | ◎ | ○ | X | X | ○ |
| | Putter | ○ | ◎ | ◎ | ◎ | X | X | X |

As is evident from Table 2, the ball of Comparative Example 1 which is a conventional two-piece solid golf ball is substantially satisfactory in distance and durability, but gives a hard feel when hit with either a driver or a putter.

The ball of Comparative Example 2 which is a three-piece solid golf ball as described in JP-A 9-313643 is durable, but somewhat short in distance and gives a hard feel when hit with either a driver or a putter.

The ball of Comparative Example 3 which is a four-piece solid golf ball as described in JP-A 10-127819 travels a shorter distance and is less durable because the hardness and thickness of the respective layers are not adequate so that an energy loss is induced at the interface between adjacent layers. Since the relatively hard cover is thick, the ball gives a hard feel upon hitting to a small extent of deformation (putter).

In contrast, the balls of Examples 1 to 4, in which the material, thickness and hardness of the respective layers are properly selected so as to construct a ball structure capable of minimizing an energy loss, have a high resilience, improved flight performance and durability, and give a very soft feel when hit with either a driver or a putter.

Examples 5–9

Core-forming rubber compositions of the formulation shown in Table 3 were mixed in a kneader and molded and vulcanized in a core mold at a temperature of 155° C. for about 15 minutes, forming solid cores.

Around the cores, the enclosure layer, intermediate layer and cover were formed by injection molding the corresponding materials of the formulation shown in Table 3, respectively, obtaining solid golf balls of four-layer structure in Examples 5–9.

The golf balls were examined by the same tests as in Example 1. The results are shown in Table 4.

TABLE 3

| | composition (parts by weight) | | | | |
|---|---|---|---|---|---|
| | E5 | E6 | E7 | E8 | E9 |
| Layer structure | 4L | 4L | 4L | 4L | 4L |
| Solid core | | | | | |
| Cis-1,4-polybutadiene | 100 | 100 | 100 | 100 | 100 |
| Zinc diacrylate | 19.1 | 27.2 | 23.2 | 27.6 | 19.2 |
| Dicumyl peroxide | 0.9 | 0.9 | 0.9 | 0.9 | 0.9 |

TABLE 3-continued

| | composition (parts by weight) | | | | |
|---|---|---|---|---|---|
| | E5 | E6 | E7 | E8 | E9 |
| Antioxidant | 0.2 | 0.2 | 0.2 | 0.2 | 0.2 |
| Zinc oxide | 5.0 | 5.0 | 5.0 | 5.0 | 5.0 |
| Barium sulfate | 20.1 | 22.6 | 10.9 | 14.1 | 17.7 |
| Enclosure layer | | | | | |
| Hytrel 3078 | 100 | 100 | | | 100 |
| Pandex EX7890 | | | 100 | | |
| Hytrel 4001 | | | | 100 | |
| Intermediate layer | | | | | |
| Himilan 1601 | 50 | | | | |
| Himilan 1557 | 50 | | | | |
| Himilan 1706 | | 60 | 60 | 45 | 60 |
| Surlyn 8120 | | 40 | 40 | 55 | 40 |
| Barium sulfate | | | | | 17 |
| Cover | | | | | |
| Himilan 1601 | 50 | | | | 50 |
| Himilan 1557 | 50 | | | 60 | 50 |
| Himilan 1706 | | 60 | 60 | | |
| Surlyn 8120 | | 40 | 40 | 40 | |
| Barium sulfate | 28 | 28 | 28 | 28 | 17 |
| Titanium dioxide | 5.6 | 5.6 | 5.6 | 5.6 | 5.6 |

Hytrel: the trade name of thermoplastic polyester elastomer by Toray-Dupont K.K.

Pandex: the trade name of polyurethane elastomer by Dai-Nippon Ink & Chemicals K.K.

Pebax: the trade name of polyamide elastomer by Atochem

Himilan: the trade name of ionomer resin by Mitsui-Dupont Polychemical K.K.

Surlyn: the trade name of ionomer resin by Dupont

TABLE 4

| | | E5 | E6 | E7 | E8 | E9 |
|---|---|---|---|---|---|---|
| Core | Outer diameter (mm) | 33.7 | 30.7 | 32.7 | 33.7 | 33.7 |
| | Hardness (mm) | 5.4 | 3.4 | 4.5 | 3.4 | 5.4 |
| Enclosure layer | Thickness (mm) | 1.5 | 3.0 | 2.0 | 1.5 | 1.5 |
| | Shore D hardness | 30 | 30 | 40 | 40 | 30 |
| Intermediate layer | Thickness (mm) | 1.5 | 1.5 | 1.5 | 1.5 | 1.5 |
| | Shore D hardness | 59 | 56 | 56 | 53 | 58 |
| | Specific gravity | 0.98 | 0.98 | 0.98 | 0.98 | 1.10 |
| Cover | Thickness (mm) | 1.5 | 1.5 | 1.5 | 1.5 | 1.5 |
| | Shore D hardness | 62 | 59 | 59 | 56 | 61 |
| | Specific gravity | 1.17 | 1.17 | 1.17 | 1.17 | 1.10 |
| Ball | Diameter (mm) | 42.7 | 42.7 | 42.7 | 42.7 | 42.7 |
| | Weight (g) | 45.3 | 45.3 | 45.3 | 45.3 | 45.3 |
| | Hardness (mm) | 3.9 | 3.2 | 3.4 | 3.2 | 4.0 |
| Flight performance @HS45 | Carry (m) | 209.5 | 210.4 | 210.0 | 210.2 | 209.0 |
| | Total (m) | 223.5 | 223.1 | 222.7 | 222.5 | 223 |
| Durability | | 0/10 | 0/10 | 0/10 | 0/10 | 0/10 |
| Feel | Driver | ◎ | ○ | ◎ | ○ | ◎ |
| | Putter | ○ | ◎ | ◎ | ◎ | ○ |

As is evident from Table 4, the balls of Examples 5 to 9, in which the material, thickness and hardness of the respective layers are properly selected so as to construct a ball structure capable of minimizing an energy loss, have a high resilience, improved flight performance, a very soft feel when hit with either a driver or a putter, and high durability against consecutive strikes.

Japanese Patent Application Nos. 10-234451 and 10-234456 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising; a solid core, an enclosure layer of at least one layer around the core, an intermediate layer around the enclosure layer, and a cover of at least one layer around the intermediate layer, wherein said enclosure layer is composed mainly of a thermoplastic resin and has a Shore D hardness in the range of 15 to 47, said solid core has a hardness corresponding to a deflection of 2.5 to 7.0 mm under an applied load of 100 kg, said intermediate layer and said cover are formed mainly of thermoplastic resins of the same type, said intermediate layer has a Shore D hardness in the range of 45 to 63, said cover has a Shore D hardness of in the range of 53 to 63, and the Shore D hardness of said cover is higher than the Shore D hardness of said intermediate layer.

2. The multi-piece solid golf ball of claim 1 wherein said cover and said intermediate layer have a total thickness of 1.5 to 5.0 mm, and said enclosure layer has a thickness of 1.0 to 5.0 mm.

3. The multi-piece solid golf ball of claim 1 wherein said cover and said intermediate layer are formed mainly of ionomer resins.

4. The multi-piece solid golf ball of claim 1 wherein said enclosure layer has a Shore D hardness of 10 to 50, and the Shore D hardness of said enclosure layer is lower than the Shore D hardness of said intermediate layer.

5. The multi-piece solid golf ball of claim 1, wherein the Shore D hardness of the intermediate layer is 5 to 50 units higher than the Shore D hardness of the enclosure layer.

6. The multi-piece solid golf ball of claim 1, wherein said enclosure layer has a thickness in the range of 1.0 to 5.0 mm, said intermediate layer has a thickness in the range of 0.5 to 3.5 mm and said cover has a thickness in the range of 0.5 to 3.5 mm.

7. The multi-piece solid golf ball of claim 1, wherein the golf ball as a whole has a deflection of 2.0 to 5.5 mm under an applied load of 100 kg.

8. A multi-piece solid golf ball comprising a solid core, an enclosure layer of at least one layer around the core, an intermediate layer around the enclosure layer, and a cover of at least one layer around the intermediate layer, wherein said enclosure layer is composed mainly of a thermoplastic resin having a Shore D hardness in the range of 15 to 47, said solid core has a hardness corresponding to a deflection of 2.5 to 7.0 mm under an applied load of 100 kg, said intermediate layer and said cover are formed mainly of thermoplastic resins of the same type, said intermediate layer has a Shore D hardness of 45 to 63, said cover has a Shore D hardness of in the range of 53 to 65, the Shore D hardness of said cover is higher than the Shore D hardness of said intermediate layer, and at least one of said intermediate layer and said cover contains an inorganic filler.

9. The multi-piece solid golf ball of claim 8 wherein said cover and said intermediate layer have a total thickness of 1.5 to 5.0 mm, and said enclosure layer has a thickness of 1.0 to 5.0 mm.

10. The multi-piece solid golf ball of claim 8 wherein said cover and said intermediate layer are formed mainly of ionomer resins.

11. The multi-piece solid golf ball of claim 8 wherein said enclosure layer has a Shore D hardness of 10 to 50, and the Shore D hardness of said enclosure layer is lower than the Shore D hardness of said intermediate layer.

12. The multi-piece solid golf ball of claim 8 wherein the layer containing the inorganic filler has a specific gravity of 1.0 to 1.5.

13. The multi-piece solid golf ball of claim 8 wherein the inorganic filler is barium sulfate.

14. The multi-piece solid golf ball of claim 8, wherein the Shore D hardness of the intermediate layer is 5 to 50 units higher than the Shore D hardness of the enclosure layer.

15. The multi-piece solid golf ball of claim 8, wherein said enclosure layer has a thickness in the range of 1.0 to 5.0 mm, said intermediate layer has a thickness in the range of 0.5 to 3.5 mm and said cover has a thickness in the range of 0.5 to 3.5 mm.

16. The multi-piece solid golf ball of claim 8, wherein the golf ball as a whole has a deflection of 2.0 to 5.5 mm under an applied load of 100 kg.

* * * * *